US006189166B1

(12) United States Patent
Braine et al.

(10) Patent No.: US 6,189,166 B1
(45) Date of Patent: Feb. 20, 2001

(54) BABY BLANKET

(76) Inventors: Kimberly Braine, 7786 Waters Edge Dr., Mason, OH (US) 45040; Penelope Ann Schindel, 110 Kiskiac Turn, Yorktown, VA (US) 23693

( * ) Notice: Under 35 U.S.C. 154(b), the term of this patent shall be extended for 0 days.

(21) Appl. No.: 09/340,694

(22) Filed: Jun. 29, 1999

Related U.S. Application Data

(60) Provisional application No. 60/094,550, filed on Jul. 29, 1998.

(51) Int. Cl.[7] ..... A47G 9/02
(52) U.S. Cl. ..... 5/482; 5/494; 5/655; 2/69
(58) Field of Search ..... 5/482, 494, 655; 2/69

(56) References Cited

U.S. PATENT DOCUMENTS

| | | | | |
|---|---|---|---|---|
| D. 269,658 | | 7/1983 | Bor . | |
| D. 330,990 | | 11/1992 | Barnes . | |
| D. 361,686 | | 8/1995 | Stearns . | |
| 4,125,903 | | 11/1978 | Farrell . | |
| 4,172,300 | * | 10/1979 | Miller | 5/494 X |
| 4,993,090 | | 2/1991 | Ranalli . | |
| 5,243,724 | * | 9/1993 | Barnes | 5/482 |
| 5,244,278 | * | 9/1993 | Robitaille | 383/4 |
| 5,692,257 | | 12/1997 | Albertieri . | |
| 5,802,811 | * | 9/1998 | Danzig | 53/429 |
| 5,893,171 | * | 4/1999 | Ries | 2/48 |
| 5,897,164 | * | 4/1999 | Kagan et al. | 2/69 X |
| 5,918,311 | * | 7/1999 | Lampson et al. | 2/49.2 |
| 5,933,886 | * | 8/1999 | Washington | 5/494 |

FOREIGN PATENT DOCUMENTS

| | | |
|---|---|---|
| 969879 | 12/1950 | (FR) . |
| 1263071 | 2/1972 | (GB) . |
| 2079596 | 1/1982 | (GB) . |

* cited by examiner

*Primary Examiner*—Terry Lee Melius
*Assistant Examiner*—James M Hewitt
(74) *Attorney, Agent, or Firm*—Richard C. Litman

(57) ABSTRACT

A miniature baby blanket for comforting a child. The blanket has a small slit in one corner for attaching the blanket to a button or a snap on the child's clothing. The slit can also be used with a strap to attach the blanket to the child's car seat, high chair, or crib. The blanket is of flannel and has a satin edging to make it attractive to babies. The invention includes a kit of three blankets to be used in rotation. A method of comforting a child by attaching the blanket to the child's clothing is also disclosed.

8 Claims, 2 Drawing Sheets

BABY BLANKET

CROSS-REFERENCE TO RELATED APPLICATION

This application claims the benefit of U.S. Provisional Patent Application Ser. No. 60/094,550, filed Jul. 29, 1998.

BACKGROUND OF THE INVENTION

1. Field of the Invention

The present invention relates generally to blankets for comforting a child, and specifically to a miniature baby blanket having a satin edging and a slit in one corner for attaching the blanket to the child's clothing, car seat, etc.

2. Description of Related Art

Small children frequently become attached to a particular comfort object or lovey. The comfort object helps a baby to relax and feel comfortable, particularly in stressful situations or when falling asleep. Since the comfort object helps a baby to comfort himself or herself comfort objects are a considerable convenience for caregivers. Blankets are often adopted by babies as comfort objects.

Ordinary baby blankets have several disadvantages as comfort objects. Typical baby blankets are primarily intended to cover or wrap a sleeping baby. The baby blanket therefore has a length of three feet or more, considerably longer than the length of the baby. The most common way for a child to use a comfort object is by holding it against his face, often while sucking a thumb at the same time. When held in this position by a sitting or standing child, the typical blanket drags on the floor or the ground. When used as a comfort object, such a large blanket tends to become entangled around the baby. The blanket can easily end up covering the baby's face, which may be a risk factor for crib death. The blanket can also be stepped on, tripping a beginning walker.

The typical baby blanket is easily dropped. Very young infants lack the coordination to hang on to an object for any length of time. Older babies often make a game of deliberately dropping things from their high chair or crib. A caregiver may spend a considerable amount of time picking up the blanket again and again and returning it to the baby.

Ordinary baby blankets are also easily misplaced. The baby may drop the blanket anywhere, either in the house, the car, or outside. Continually locating the blanket is a frustrating task, particularly under pressure from a crying baby. The blanket can also be lost permanently, which can lead to a time-consuming search for a duplicate blanket that the baby will accept.

Given the normal tendency of babies to spit up, overflow their diapers, smear food, and generally make a mess, baby blankets require frequent laundering. For an older baby capable of walking, the laundering is increased by the blanket dragging on the floor and the ground. Due to the baby's attachment, it is difficult for the caregiver to take a soiled blanket away for laundering. This can lead to a vicious cycle in which laundering is postponed and the baby becomes attached to the gamy smell of the unwashed blanket. When the blanket is finally washed, the baby may reject the clean-smelling blanket. The convenience of having a comfort object is lost.

Examples found in the patent literature describe a variety of baby blankets, often having the above disadvantages. U.S. Pat. No. 4,125,903 by Farrell discloses a baby blanket having a holding compartment for holding a baby. U.S. Pat. No. 4,993,090 by Ranalli discloses a blanket for covering a child in a car seat fitted with a harness. The blanket has apertures through which the restraining members of the harness can be passed. The blanket has an interior portion that lies between the child and the car seat and an exterior portion for wrapping around the child after the harness has been secured.

None of the above inventions and patents, taken either singly or in combination, is seen to describe the instant invention as claimed.

SUMMARY OF THE INVENTION

The present invention is a miniature baby blanket for comforting a child. The baby blanket has a satin edging and a small slit in one corner for attaching the blanket to the child's clothing, car seat, etc.

Accordingly, it is a principal object of the invention to provide a baby blanket having soft flannel and satin surfaces suitable for use as a comfort object by a baby or small child.

It is another object of the invention to provide a miniature baby blanket which is easily and safely handled by a child, easily cleaned, simple to manufacture, and sufficiently inexpensive to be provided in triplicate.

It is a further object of the invention to provide a baby blanket having a slit near one corner, the slit serving to fasten the blanket to a button on the child's clothing, or to hold a strap for fastening the blanket to the child's clothing, car seat, bouncer seat, high chair, etc.

Still another object of the invention is to provide a kit including three blankets for comforting a child.

It is an object of the invention to provide improved elements and arrangements thereof in an apparatus for the purposes described which is dependable and fully effective in accomplishing its These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a miniature baby blanket for comforting a child. The baby blanket has a satin edging and a slit in one corner for attaching the blanket to the child's clothing, car seat, etc.

Figure 1:
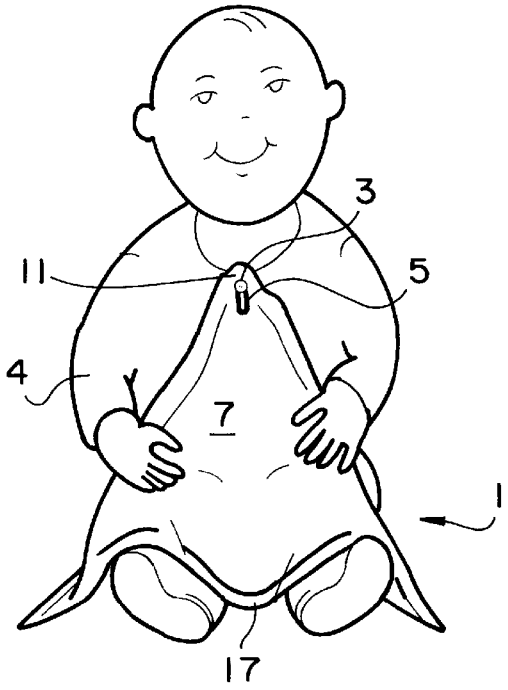
FIG. 1 is an environmental, perspective view of a baby blanket attached to a button on a child's clothing.

FIG. 1 is an environmental, perspective view of a baby blanket 1 attached to a button 3 attached to a child's clothing 4. The slit 5 slips over the button 3 and holds the baby blanket 1 continually within the baby's reach.

Figure 2:
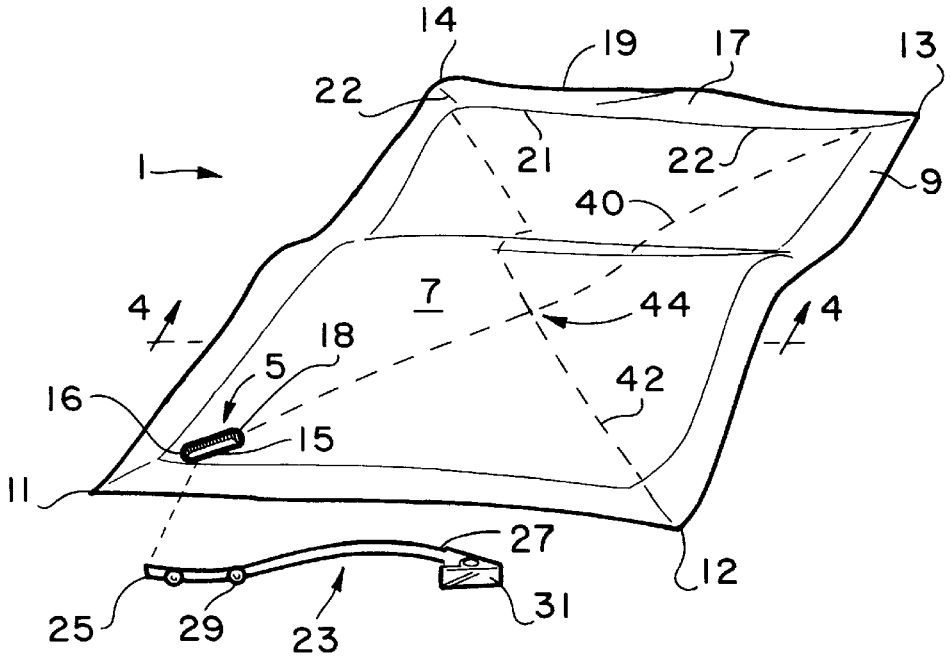
FIG. 2 is an environmental, perspective view of a baby blanket having a strap.
Figure 4:
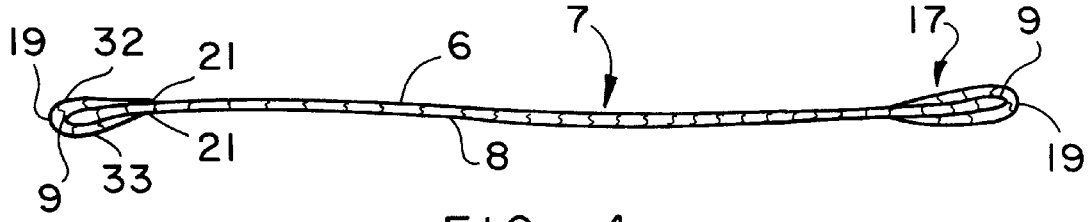
FIG. 4 is a cross-sectional view of the blanket of FIG. 2.

FIG. 2 is an environmental, perspective view of a baby blanket 1. The blanket 1 includes a piece of fabric 7. The fabric 7 is composed of at least one layer of flannel. Preferably the flannel is a lightweight flannel. Preferably the flannel is decorated with an appropriate baby-oriented design. The design is preferably printed or silkscreened, but may be appliqued or embroidered. Preferably the fabric 7 is composed of two layers of flannel, 6 and 8, as shown in FIG. 4. The double layer of flannel allows for both surfaces of the baby blanket 1 to have the right side of the design showing. Flannel is soft, has a pleasant feel, and is easily washable. The flannel helps the baby to accept the blanket 1 as a comfort object.

The fabric 7 is generally rectangular. The fabric 7 has a length and a width. Preferably the fabric length and width are approximately equal. The fabric 7 has an outer edge 9, four corners 11, 12, 13, and 14, and two diagonals 40, 42. Each diagonal 40, 42 connects two of the opposing corners, 11 and 13 or 12 and 14 respectively, and the center 44 of the fabric. The fabric length and width each are at least six inches. The fabric length and width are each shorter than the length of an average newborn infant, or less than about 21 inches. The fabric length preferably ranges from about 8 to about 13 inches. Most preferably the fabric length and width are about 11 inches.

The blanket 1 is a miniature blanket. The size of the blanket 1 has several advantages. The blanket is large enough for a small infant to easily hold onto and develop an attachment. The blanket 1 is too short for a baby to entangle himself in it or wrap it around his or her head or neck. The blanket 1 is less likely to cover the entire face of a sleeping baby, helping to reduce one of the risk factors for crib death. By the time the baby is able to crawl, his or her length has increased relative to that of the blanket 1 so that the blanket 1 does not interfere with crawling. As the baby learns to walk, the blanket 1 is short enough that he cannot step on it and trip himself. The miniature blanket 1 is too short to drag on the floor or the ground, and stays cleaner.

When necessary, the blanket 1 is easily washed. The miniature blanket 1 takes up very little space in a washing machine and can be easily included in any load. In a pinch, the blanket 1 can be quickly hand washed in a small sink. The blanket 1 can be dried in just a few minutes in a clothes dryer. It can even be dried quickly with a hair dryer when traveling.

The fabric has a slit 5, as shown in FIGS. 1 and 2. The slit 5 is linear and is formed by cutting the fabric 7 without removing any fabric 7. The slit 5 extends completely through all layers of the fabric 7. If the slit 5 is located closer to the outer edge 19 of the fabric than the width of the edging 17, the slit 5 also extends through the edging 17.

The slit 5 has first and second ends 16 and 18. The slit 5 is located near one of the corners 11. Preferably the slit 5 is located on and oriented parallel to the diagonal 40 connecting the corner 11 near the slit 5 with the center 44. See FIG. 2. This orientation allows the blanket to set firmly in place on a button 3 when the blanket is pulled on by the child, no matter which direction the child pulls the blanket. There is little tendency for the blanket to come off the button accidentally.

Preferably the blanket 1 has exactly one slit 5. One slit 5 is sufficient for attaching the blanket 1. A single slit 5 reduces manufacturing costs. However, the blanket 1 may have two or more slits 5 in various corners.

The slit 5 is located far enough from the corner 11 so that the slit will not tear through to the outer edge 9, even after prolonged use. The slit 5 is located close enough to the edge of the blanket to make the corner between the slit and the edge difficult for the child to grasp. The slit 5 is also located close enough to the edge of the blanket so that a strap 23 can be attached without bunching up the blanket. Preferably the slit 5 is located between one and three inches from the corner 11 nearest the slit 5. Most preferably the slit 5 is located approximately 1½ inches from the corner 11 near the slit 5.

The slit 5 has a length and a perimeter 15. The slit length ranges from about 5/16 inch to about 1 inch. Preferably the slit length is about ½ inch. The slit length is long enough to accommodate a typical button 3 on a child's shirt or a small strap 23. The slit length is short enough so that a button 3 through the slit will hold the blanket 1 securely in place attached to the child's clothing. The slit length is also short enough so that the slit 5 is not a strangulation hazard and does not catch accidentally on objects.

The slit perimeter 15 is closed and does not extend through to the outer edge 9 of the fabric 7. The slit perimeter 15 is also finished to avoid fraying of the fabric 7. Preferably the slit perimeter 15 is finished with a zigzag buttonhole stitch.

The baby blanket 1 includes an edging 17. The edging 17 is composed of satin ribbon. Babies like the feel of satin and the satin helps the baby to accept the blanket 1 as a comfort object. The edging 17 is folded approximately in half lengthwise along a fold line 19. The edging 17 has two parallel edges 21 extending lengthwise. The edging 17 has a width extending from the fold line 19 to either of the edging edges 21. Preferably the width of the edging 17 ranges from about ½ inch to about 2½ inches. The most common satin ribbon widths are 1½ and 4 inches, for an edging width of ¾ inch or 2 inches on each side.

The slit 5 may be closer to the outer edge 9 of the blanket 1 than the width of the edging. In this case the slit 5 passes through both portions 32 and 33 of the edging as well as the two fabric layers 6 and 8. This makes finishing the perimeter 15 somewhat more complex. To avoid this, most preferably the width of the edging 17 is about ¾ inch. This width provides enough satin for the blanket 1 to be attractive to a baby.

The slit 5 allows the blanket 1 to be easily attached to the child's clothing. If the child's clothing includes one or more buttons 3, the blanket can be buttoned on. This keeps the blanket 1 in the right position for the child to hold. The blanket 1 remains within reach, no matter how many times the child drops it. The child can even roll around or crawl without detaching the blanket 1. Since the blanket 1 is attached to the baby, the blanket 1 is less likely to be accidentally left somewhere, lost under furniture, or the like. This saves time and frustration for the caregiver.

The slit 5 also allows for several other attachment methods. If the collar area of the child's clothing includes a snap fastener, one side of the snap can be passed through the slit 5, and the snap fastened as usual. If the collar is secured by ties, the ties can be secured through the slit 5.

Where the child's clothing has no convenient buttons, snaps, or the like, the blanket 1 can be secured by a strap 23. The strap 23 is of conventional design and has a first end 25 and a second end 27. The first and second ends 25 and 27 each have a fastener. The first end 25 passes through the slit 5. The first end fastener is adapted to releasably attaching the first end 25 of the strap 23 to the fabric. The second end fastener is adapted to releasably attaching the second end 27 to the child's clothing or some other object. Preferably the strap 23 is short enough so that it has no more than 6 inches of play after attachment. This length is short enough to avoid creating a strangulation hazard.

The first and second end fasteners may be any of a variety of fasteners, including ties and hook and loop fasteners. The end fasteners may be keyhole fasteners, in which the end of the strap 23 has a tab, and holes with a keyhole shape corresponding to the tab are spaced along the length of the strap. Preferably the first end fastener is a snap fastener 29, and the second end fastener is a clip 31. See FIG. 2. The clip 31 attaches to the child's clothing, while the snap fastener 29 attaches to the slit of the blanket. Suitable straps with fasteners are available under the trademarks The First Years and Baby Buddy.

The strap 23 allows for additional flexibility in using the blanket 1. The clip 31 allows for attaching the blanket 1 to any type of clothing. Hook and loop fastener, keyhole fastener or tie may be used to attach the blanket 1 to a car seat, bouncer seat, high chair, or crib. These fasteners may also be used to attach the blanket 1 to the baby's wrist or to certain types of clothing, such as overall straps.

The strap 23 keeps the blanket 1 within reach, even for a very young infant lacking the ability to reliably hold on to an object. The strap 23 ends the game of an older baby deliberately dropping the blanket 1 and crying for it to be retrieved. This saves the caregiver a considerable amount of time and aggravation.

Figure 3:
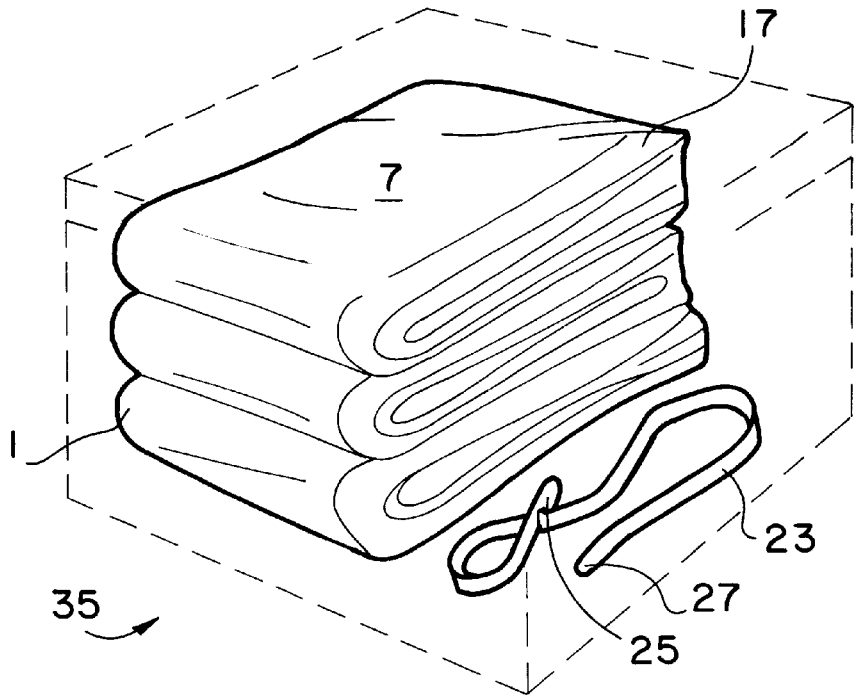
FIG. 3 is an environmental, perspective view of a kit including three blankets and a strap.

FIG. 3 is an environmental, perspective view of a kit 35 for comforting a child. The kit 35 includes three blankets 1. Each blanket 1 is similar to the blanket 1 of FIGS. 1 and 2 and has an edging 17 and a piece of fabric with a slit 5. The kit 35 may include only the three blankets 1. Alternatively, the kit 35 may also have a strap 23 with fasteners on each end.

The kit 35 allows for three comfort objects to be introduced at the same time. This eliminates the problem of having to search for a duplicate later on when the comfort object is lost or worn out. All of the blankets smell right to the baby and are easily switched without the baby catching on. The small size and simple construction of the blanket 1 allow it to be inexpensively provided in triplicate. The blankets 1 can be laundered in rotation without upsetting the child, keeping each one clean and fresh-smelling. Having three identical blankets 1 available allows for laundering one and losing one, while still keeping the child happy. The additional strap 23 allows for maximum flexibility in using the blankets 1.

FIG. 4 is a diagrammatic, cross-sectional view of the baby blanket 1 of FIG. 1, taken along line 4—4. The edging 17 has a first portion 32 on one side of the fold line 19, and a second portion 33 on the opposite side of the fold line 19. The outer edge 9 of the fabric 7 is located between the first portion 32 and the second portion 33 of the edging 17. The edging 17 is attached to the outer edge 9 of the fabric 7 by stitching 22 at each of the edging edges 21. Preferably the stitching is a zigzag or blanket stitch.

The present invention also includes a method of comforting a child. The method includes a first step of selecting a blanket 1. Another step is selecting a button 3 attached to the child's clothing. The next step is passing the button through the slit 5 of the blanket, so that the blanket is attached to the child's clothing 4. The method may include a step of pulling on the blanket to place the button adjacent to the first end 16 of the slit.

It is to be understood that the present invention is not limited to the sole embodiments described above, but encompasses any and all embodiments within the scope of the following claims.

We claim:

1. A blanket for comforting a child comprising:

(a) a piece of fabric, the fabric being composed of at least one layer of flannel, the fabric being generally rectangular, the fabric having a length, a width, an outer edge, four corners, and two diagonals, each diagonal connecting two of the corners and a center of the fabric, the fabric length and width each being at least six inches, the fabric length and width each being shorter than 21 inches;

(b) at least one slit, the at least one slit being linear and located in the fabric near one of the corners, the at least one slit being oriented parallel to a diagonal connecting the corner near the at least one slit with the center, the at least one slit having a length and a perimeter, the at least one slit length ranging from about 5/16 inch to about 1 inch, the at least one slit perimeter being closed and finished;

(c) an edging, the edging being composed of ribbon, the ribbon being satin, the edging being folded approximately in half lengthwise along a fold line, the edging having two edges, a width extending from the fold line to one of the edging edges, a first portion on one side of the fold line, and a second portion on the opposite side of the fold line, the outer edge of the fabric being located between the first portion and the second portion of the edging, the edging being attached to the outer edge of the fabric by stitching; and (d) a strap having a first end and a second end, the first end of the strap passing through the at least one slit, the first and second ends of the strap each having a fastener, and the first end fastener being adapted to releasably attach the first end of the strap to the fabric.

2. The blanket according to claim 1, wherein the at least one slit is located on the diagonal connecting the corner near the at least one slit with the center, the at least one slit perimeter is finished by stitching, the fabric length and width are approximately equal, the fabric length ranges from about 8 to about 13 inches, and the width of the edging ranges from about ½ inch to about 2½ inches.

3. The blanket according to claim 2, wherein the fabric is composed of two layers of flannel.

4. The blanket according to claim 3, wherein the fabric length is about 11 inches, the at least one slit length is about ½ inch, the width of the edging is about ¾ inch, and the at least one slit is located approximately 1½ inches from the corner near the at least one slit.

5. The blanket according to claim 2, wherein the fabric consist of one slit.

6. The blanket according to claim 1, wherein the first end fastener is a snap fastener, and the second end fastener is a clip.

7. A kit for comforting a child comprising three blankets, and a strap; wherein each blanket having a piece of fabric, the fabric being composed of at least one layer of flannel, the fabric being generally rectangular, the fabric having a length, a width, an outer edge, four corners, and two diagonals, each diagonal connecting each two opposing corners and a center of the fabric, the fabric length and width each being at least six inches, the fabric length and width each being shorter than 21 inches;

at least one slit, the at least one slit being linear and located in the fabric near one of the corners, the at least one slit being oriented parallel to the diagonal connecting the corner near the at least one slit with the center, the at least one slit having a length and a perimeter, the at least one slit length ranging from about 5/16 inch to about 1 inch, the at least one slit perimeter being closed and finished; and an edging, the edging being composed of ribbon, the ribbon being satin, the edging being folded approximately in half lengthwise along a fold line, the edging having two edges, a width lengthwise along a fold line, the edging having two edges, a first portion on one side of the fold line, and a second portion on the opposite side of the fold line, the outer edge of the fabric being located between the first portion and the second portion of the edging, the edging being attached to the outer edge of the fabric by stitching; and wherein the strap having a first end and a second end, the first and second ends of the strap each having a fastener, the first end of the strap passing through the at least one slit, the first end fastener being adapted to releasably attach the first end of the strap to the fabric.

8. A method of comforting a child, comprising the steps of:

(a) selecting a blanket, the blanket having:

(i) a piece of fabric, the fabric being composed of at least one layer of flannel, the fabric being generally rectangular, the fabric having a length, a width, an outer edge, four corners, and two diagonals, each diagonal connecting two of the corners and a center of the fabric, the fabric length and width each being at least six inches, the fabric length and width each being shorter than 21 inches;

(ii) a slit, the slit being linear and located in the fabric near one of the corners, the slit being oriented parallel to the diagonal connecting the corner near the slit with the center, the slit having a first end, an opposite second end, a length, and a perimeter, the second end of the slit being located closer to the center of the fabric than the first end of the slit, the slit length ranging from about 5/16 inch to about 1 inch, the slit perimeter being closed and finished; and (iii) an edging, the edging being composed of ribbon, the ribbon being satin, the edging being folded approximately in half lengthwise along a fold line, the edging having two edges, a width extending from the fold line to one of the edging edges, a first portion on one side of the fold line, and a second portion on the opposite side of the fold line, the outer edge of the fabric being located between the first portion and the second portion of the edging, the edging being attached to the outer edge of the fabric by stitching;

(b) selecting a button attached to clothing, the clothing being worn by the child;

(c) passing the button through the slit of the blanket, so that the blanket is attached to the clothing and the blanket remains within reach of the child; and (d) pulling on the blanket to place the button adjacent to the first end of the slit.

* * * * *